US011410793B2

(12) United States Patent
Shimizu et al.

(10) Patent No.: US 11,410,793 B2
(45) Date of Patent: Aug. 9, 2022

(54) BENDING-RESISTANT COMMUNICATION CABLE AND WIRE HARNESS

(71) Applicant: YAZAKI CORPORATION, Tokyo (JP)

(72) Inventors: Toshiharu Shimizu, Susono (JP); Hiroki Kondo, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 142 days.

(21) Appl. No.: 16/878,554

(22) Filed: May 19, 2020

(65) Prior Publication Data

US 2020/0373036 A1 Nov. 26, 2020

(30) Foreign Application Priority Data

May 20, 2019 (JP) ..... JP2019-094348

(51) Int. Cl.
*H01B 7/18* (2006.01)
*H01B 7/00* (2006.01)

(52) U.S. Cl.
CPC ..... *H01B 7/1865* (2013.01); *H01B 7/0045* (2013.01)

(58) Field of Classification Search
CPC ..... H01B 7/0045; H01B 7/1865
See application file for complete search history.

(56) References Cited

U.S. PATENT DOCUMENTS

2007/0044994 A1* 3/2007 Park ..... H01B 11/06 174/113 C
2009/0241314 A1* 10/2009 Watanabe ..... H01B 13/0271 29/33 F
2010/0108349 A1* 5/2010 Baeck ..... H01B 11/06 174/95
2011/0042120 A1* 2/2011 Otsuka ..... H01P 3/00 174/113 R
2011/0139485 A1* 6/2011 Matsuda ..... H01P 3/02 174/102 R
2011/0168426 A1* 7/2011 Kim ..... H01B 11/04 174/113 C (Continued)

FOREIGN PATENT DOCUMENTS

CN 105047301 A 11/2015
CN 205050581 U 2/2016

(Continued)

OTHER PUBLICATIONS

Troughton, M.J., Handbook of plastics joining : a practical guide, 2009, William Andrew Inc., 2nd Edition, pp. 345-351 (Year: 2009).*

*Primary Examiner* — William H. Mayo, III
*Assistant Examiner* — Rhadames Alonzo Miller
(74) *Attorney, Agent, or Firm* — Kenealy Vaidya LLP

(57) ABSTRACT

A bending-resistant communication cable includes a parallel two-core shielded wire that includes a drain wire in a gap between two-core communication wires and is formed by collectively covering the two-core communication wires and the drain wire by an external conductor. Each of the drain wires in a plurality of parallel two-core shielded wire is arranged to face inside of the bending-resistant communication cable. Further, a twist pitch of the plurality of two-core shielded wires is 20 mm or more and less than 100 mm.

3 Claims, 5 Drawing Sheets

(56) References Cited

U.S. PATENT DOCUMENTS

| | | | | |
|---|---|---|---|---|
| 2011/0211794 | A1* | 9/2011 | Ruzzier | G02B 6/449 385/111 |
| 2012/0103652 | A1* | 5/2012 | Ooyama | H01B 11/1091 174/105 R |
| 2013/0142491 | A1* | 6/2013 | Ruzzier | G02B 6/4401 385/100 |
| 2013/0180754 | A1* | 7/2013 | Hinoshita | H05K 9/0098 174/113 R |
| 2014/0182881 | A1* | 7/2014 | Huang | H01B 11/1091 174/103 |
| 2015/0310966 | A1* | 10/2015 | Huang | H01B 11/203 174/107 |
| 2018/0114610 | A1* | 4/2018 | Uegaki | H01B 11/02 |
| 2018/0174706 | A1* | 6/2018 | Shimosawa | H01B 7/18 |
| 2019/0077341 | A1* | 3/2019 | Kohori | H01B 9/003 |
| 2019/0172606 | A1* | 6/2019 | Kohori | H01B 7/0009 |
| 2019/0228874 | A1* | 7/2019 | Kohori | H01B 7/0216 |
| 2019/0248308 | A1* | 8/2019 | Hayakawa | B60R 16/0215 |
| 2019/0333658 | A1* | 10/2019 | Yamazaki | H01B 13/0036 |
| 2020/0243219 | A1* | 7/2020 | Li | H01B 11/002 |

FOREIGN PATENT DOCUMENTS

| | | | |
|---|---|---|---|
| JP | 2015-72774 | A | 4/2015 |
| JP | 2015-185527 | A | 10/2015 |

* cited by examiner

| BENDING TEST | | INSIDE DRAIN WIRES (REFERENCE EXAMPLE) | | OUTSIDE DRAIN WIRES (COMPARATIVE EXAMPLE 1) | |
|---|---|---|---|---|---|
|   | |   | |   | |
| | | END CLOSE TO MANDREL | END FAR FROM MANDREL | END CLOSE TO MANDREL | END FAR FROM MANDREL |
| BENDING TIMES (RECIPRO-CATING) | AVERAGE | 5867 | 11388 | 826 | 2342 |
| | MINIMUM | 4653 | 7853 | 628 | 1691 |
| | MAXIMUM | 6690 | 16056 | 1155 | 3224 |

BENDING-RESISTANT COMMUNICATION CABLE AND WIRE HARNESS

CROSS-REFERENCE TO RELATED APPLICATIONS

This application is based on and claims priority under 35 USC 119 from Japanese Patent Application No. 2019-094348 filed on May 20, 2019, the contents of which are incorporated herein by reference.

TECHNICAL FIELD

The present invention relates to a bending-resistant communication cable and a wire harness.

BACKGROUND ART

In the related art, a communication wire for an automobile has been configured to have flexibility by twisting electric wires because a large number of electric wire bending portions occur in a space-saving way due to a layout of a wire harness. However, as a communication speed increases, there is an influence of significant attenuation (suck-out) of a signal caused by a twist pitch between the electric wires and a winding pitch of a metal foil shield.

Therefore, in a consumer field, a shielded parallel pair (SPP) wire is used in which a drain wire is arranged in a gap between two-core communication wires and the two-core communication wires and the drain wire are collectively covered by a metal foil (see, for example, Patent Literature 1). Further, communication performance and a speed may be insufficient with one SPP wire, and in this case, it is also proposed that two or more SPP wires are collectively provided to form a cable (see Patent Literature 2).

CITATION LIST

Patent Literature

Patent Literature 1: JP-A-2015-185527
Patent Literature 2: JP-A-2015-72774

SUMMARY OF INVENTION

However, when the consumer SPP wire described in Patent Literature 1 is used in an automobile environment, the drain wire is likely to be broken due to vehicle vibration or bending at a movable portion. Further, for the cable described in Patent Literature 2, the drain wire may be broken in a similar way.

The present invention has been made in order to solve such a problem in the related art, and an object thereof is to provide a bending-resistant communication cable and a wire harness that improve bending resistance of a drain wire.

The present invention is a bending-resistant communication cable including a parallel two-core shielded wire that includes a drain wire in a gap between two-core communication wires and is formed by collectively covering the two-core communication wires and the drain wire by a metal foil, and a sheath that collectively covering a plurality of the parallel two-core shielded wires. In the plurality of parallel two-core shielded wires, each drain wire is arranged to face inside of the cable. The plurality of parallel two-core shielded wires are twisted with a twist pitch being 20 mm or more and less than 100 mm.

According to the present embodiment, since the drain wire of each of the plurality of parallel two-core shielded wires is arranged to face the inside of the cable, a strain applied to the drain wire can be reduced and bending resistance can be improved by increasing a distance from an outermost layer of the cable to which vehicle vibration from outside or bending is applied. Further, since a twist is performed with a twist pitch being less than 100 mm, bending resistance of the drain wires can be improved as compared with a case Where the parallel two-core shielded wires are not twisted together. Therefore, the bending resistance of the drain wires can be improved. Although a twist pitch of 20 mm may affect communication performance, a difference in an attenuation amount is within 0.1 dB/m as compared with a case where no twist exists, which is within an allowable range.

DESCRIPTION OF EMBODIMENTS

Hereinafter, the present invention will be described in accordance with a preferred embodiment. The present invention is not limited to the following embodiment, and may be modified as appropriate without departing from a scope of the present invention. Further, in the following embodiment, illustration or description of partial configurations is omitted, but it is needless to say that a technology, which is well known or commonly known, is appropriately applied to details of an omitted technology in a range in which a discrepancy from the following contents does not occur.

Figure 1:
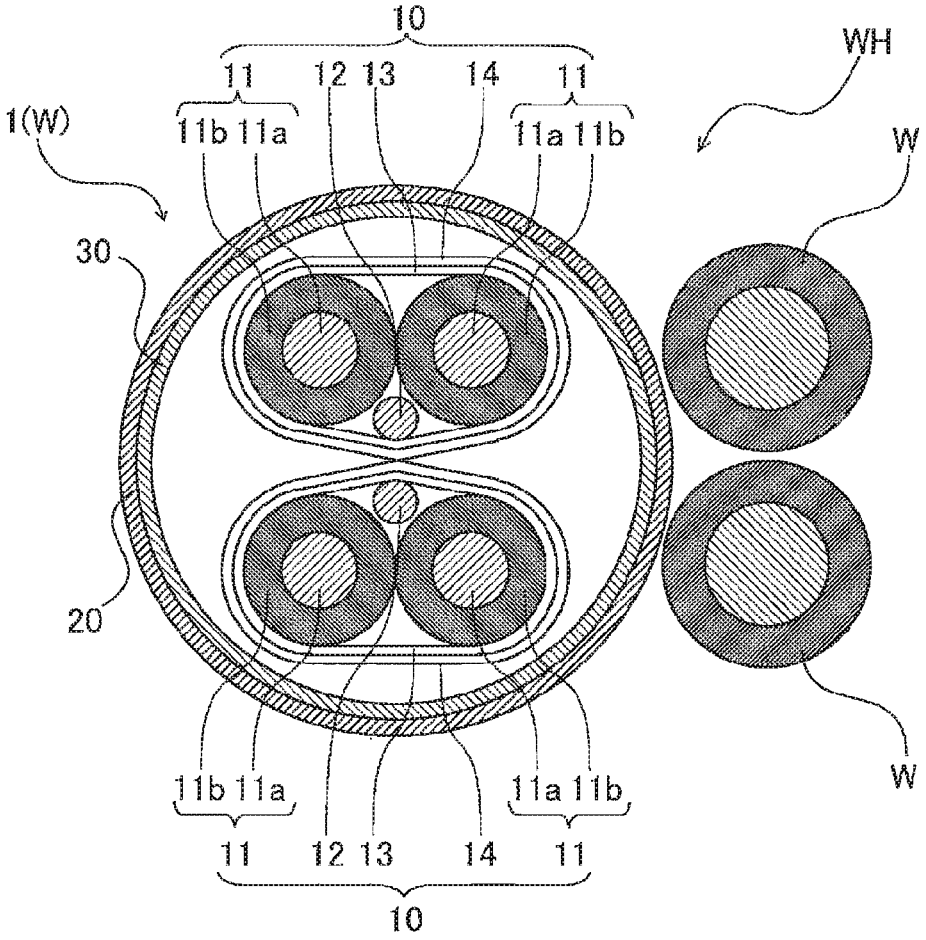
FIG. 1 is a cross-sectional view showing an example of a wire harness including a bending-resistant communication cable according to an embodiment of the present invention.
Figure 2:
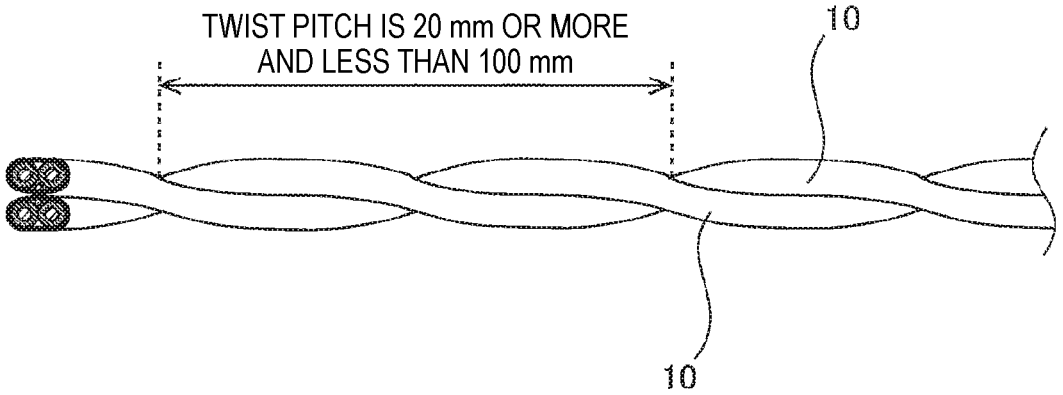
FIG. 2 is a perspective view showing a partial configuration of the bending-resistant communication cable shown in FIG. 1.

FIG. 1 is a cross-sectional view showing an example of a wire harness including a bending-resistant communication cable according to an embodiment of the present invention. FIG. 2 is a perspective view showing a partial configuration of the bending-resistant communication cable shown in FIG. 1.

As shown in FIG. 1, a wire harness WH according to the present embodiment is formed by bundling a plurality of electric wires W, and at least one (one circuit) of the plurality of electric wires is configured with a bending-resistant communication cable 1 to be described in detail below.

Such a wire harness WH may include, for example, connectors (not shown) at both ends of the plurality of electric wires W, and a tape (not shown) may be wound to bundle the bending-resistant communication cable 1. Further, the wire harness WH may include an exterior component (not shown) such as a corrugated tube.

The bending-resistant communication cable 1 includes a plurality of (for example, two) parallel two-core shielded wires 10 and a sheath 20. The parallel two-core shielded wire 10 includes two communication wires 11, a drain wire 12, an external conductor 13, and a retainer 14.

The two communication wires 11 are electric wires each having a circular cross section for signal transmission, and are arranged in parallel with each other. These two communication wires 11 each include a conductor 11*a* and an insulator 11*b*. The drain wire 12 is arranged at a position that is a gap between the two communication wires 11 when the two communication wires 11 having a circular cross section are brought into contact with each other in a radial direction, and is, for example, a bare electric wire having no coating in the present embodiment.

Here, the conductors 11*a* of the two communication wires 11 and the drain wire 12 are formed of, for example, a soft copper wire, a copper alloy wire, a tin-plated soft copper wire, a tin-plated copper alloy wire, a silver-plated soft copper wire, or a silver-plated copper alloy wire. In the present embodiment, although the conductors 11*a* and the drain wire 12 are formed of one metal wire, the conductors 11*a* and the drain wire 12 may be formed of a twisted wire in which two or more wires are twisted.

The insulator 11*b* is provided on an outer periphery of the conductor 11*a*, and is formed of, for example, polyethylene (PE), polypropylene (PP), polytetrafluoroethylene (PTFE), foamed PE, foamed PP, or foamed PTFE.

The external conductor 13 is formed of a metal foil such as an aluminum foil or a copper foil, and the metal foil collectively covers the two communication wires 11 and the drain wire 12 by longitudinal wrapping. Further, the external conductor 13 may be a resin tape to which the metal foil is adhered. The resin tape may be one in which aluminum or copper is vapor-deposited on a base material to form a metal foil. In the present embodiment, a copper foil tape is used as the external conductor 13.

The retainer 14 is an insulator provided in a contact state on an outer peripheral side of the external conductor 13, and is formed of a resin film such as PET or PTFE, or formed of a resin extrusion coating. Here, a secant modulus of the retainer 14 is preferably 2850 MPa or more and 4200 MPa or less. Accordingly, an electric wire structure can be stabilized and cannot be excessively bent during bending, and a bending R can be stabilized. In order to implement such a secant modulus, in the present embodiment, the retainer 14 is formed of a PET film, and is spirally wound so as to be doubled on the external conductor 13.

The secant modulus is an index of hardness of resin, and is a gradient (inclination) of a straight line that connects an optional point on a stress-strain curve to an origin, and particularly refers to a value obtained by multiplying a tensile strength when an elongation is 2% by 50 (in other words, a Young's modulus when the elongation is 2%). Further, the elongation of 2% may be obtained by pulling a sample with a tensile tester at a tensile speed of, for example, 50 mm/min.

The sheath 20 is an insulator that collectively covers the plurality of parallel two-core shielded wires 10, and is formed of a resin material such as polyvinyl chloride (PVC), PP, or PE. In the present embodiment, although the sheath 20 is assumed to be formed by performing extrusion molding on the plurality of parallel two-core shielded wires 10, the sheath 20 is not particularly limited to one formed by the extrusion molding.

The bending-resistant communication cable 1 may include a second shield layer 30. The second shield layer 30 is provided inside the sheath 20, and is formed of, for example, a braided shield woven with a material same as those of the conductors 11*a* of the two communication wires 11 or formed of a raw material same as that of the external conductor 13.

Here, in the present embodiment, the plurality of parallel two-core shielded wires 10 are arranged such that the drain wires 12 face inside of the bending-resistant communication cable 1. That is, in the present embodiment, the drain wires 12 are arranged to be located on a center side of the bending-resistant communication cable 1, and a distance from outside of the cable is increased.

In addition, in the present embodiment, the plurality of parallel two-core shielded wires 10 are twisted together as shown in FIG. 2, and a twist pitch thereof is 20 mm or more and less than 100 mm.

Next, Reference Example and Comparative Example related to the bending-resistant communication cable 1 according to the present embodiment will be described.

Figure 3:
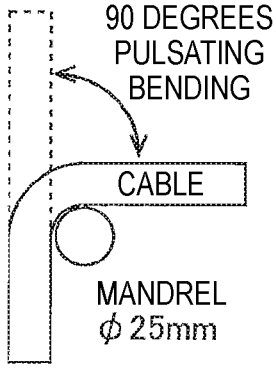
FIG. 3 is a schematic view showing bending-resistant communication cables and test states according to Reference Example and Comparative Example 1.
Figure 3:
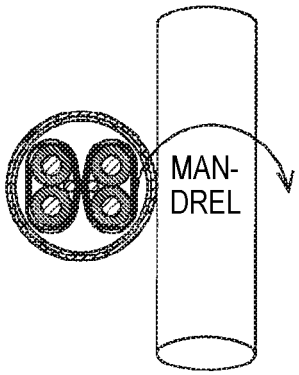
Figure 3:
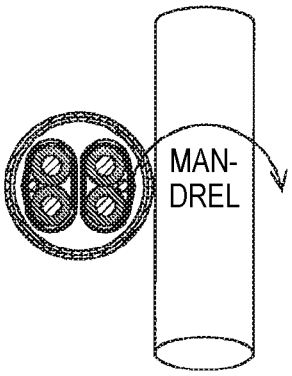

FIG. 3 is a schematic view showing bending-resistant communication cables and test states according to Reference Example and Comparative Example 1.

As shown in FIG. 3, in the bending-resistant communication cable according to Reference Example, a silver-plated soft copper wire was used for conductors of two communication wires and a drain wire, and a cross-linked polyethylene was used for insulators. Further, a copper foil PET film was used for an external conductor, and the copper foil PET film was longitudinally wrapped around the two communication wires and the drain wire. A PET film was used for a retainer, and was spirally wound twice on the external conductor. Two parallel two-core shielded wires configured in this way were prepared, and arranged in parallel without a twist pitch such that the drain wires were on inside. A tin-plated soft copper braid was used for a second shield layer, and PVC was used for a sheath.

In a bending-resistant communication cable according to Comparative Example 1, a silver-plated soft copper wire was used for conductors of two communication wires and a drain wire, and a cross-linked polyethylene was used for insulators. Further, a copper foil PET film was used for an external conductor, and the copper foil PET film was longitudinally wrapped around the two communication wires and the drain wire. A PET film was used for a retainer, and was spirally wound twice on the external conductor. Two parallel two-core shielded wires configured in this way were prepared, and arranged in parallel without a twist pitch such that the drain wires were on outside. A tin-plated soft copper braid was used for a second shield layer, and PVC was used for a sheath.

A bending test was performed on the bending-resistant communication cables according to Reference Example and Comparative Example 1 as described above. For the bending test, a mandrel of $\phi$25 mm was prepared, no load was applied to one end side of the bending-resistant communication cable having a predetermined length, and a 90° pulsating bending was repeated at a bending speed of 30 rpm so that the other end side was along the mandrel. A reciprocating bending times until a resistance value of the drain wires rose by 10% was measured as a result of the repeated bending. The measurement was performed five times, a maximum value and a minimum value were extracted, and an average value was calculated.

As shown in FIG. 3, in the bending-resistant communication cable according to Reference Example, regarding a reciprocating bending times for the drain wires on a side close to the mandrel, a maximum value is 6690, a minimum value is 4653, and an average value is 5867. In the bending-resistant communication cable according to Example 1, regarding a reciprocating bending times for the drain wires on a side far from the mandrel, a maximum value is 16056, a minimum value is 7853, and an average value is 11388.

On the other hand, in the bending-resistant communication cable according to Comparative Example 1, regarding a reciprocating bending times for the drain wires on a side close to the mandrel, a maximum value is 1155, a minimum value is 628, and an average value is 826. In the bending-resistant communication cable according to Comparative Example 1, regarding a reciprocating bending times for the drain wires on a side far from the mandrel, a maximum value is 3224, a minimum value is 1691, and an average value is 2342.

Therefore, it is found that the drain wires are arranged to face the inside of the bending-resistant communication cable, thereby improving the bending resistance. In particular, the reciprocating bending times of the drain wires (both on the side close to the mandrel and on the side far from the mandrel) in Reference Example is larger than that of the drain wires on the side far from the mandrel in Comparative Example 1. That is, it is found that the bending resistance of the drain wires is not increased as the drain wires are located on an outer side of the bending and it is important that the drain wires are arranged on an inner side of the cable.

Figure 4:
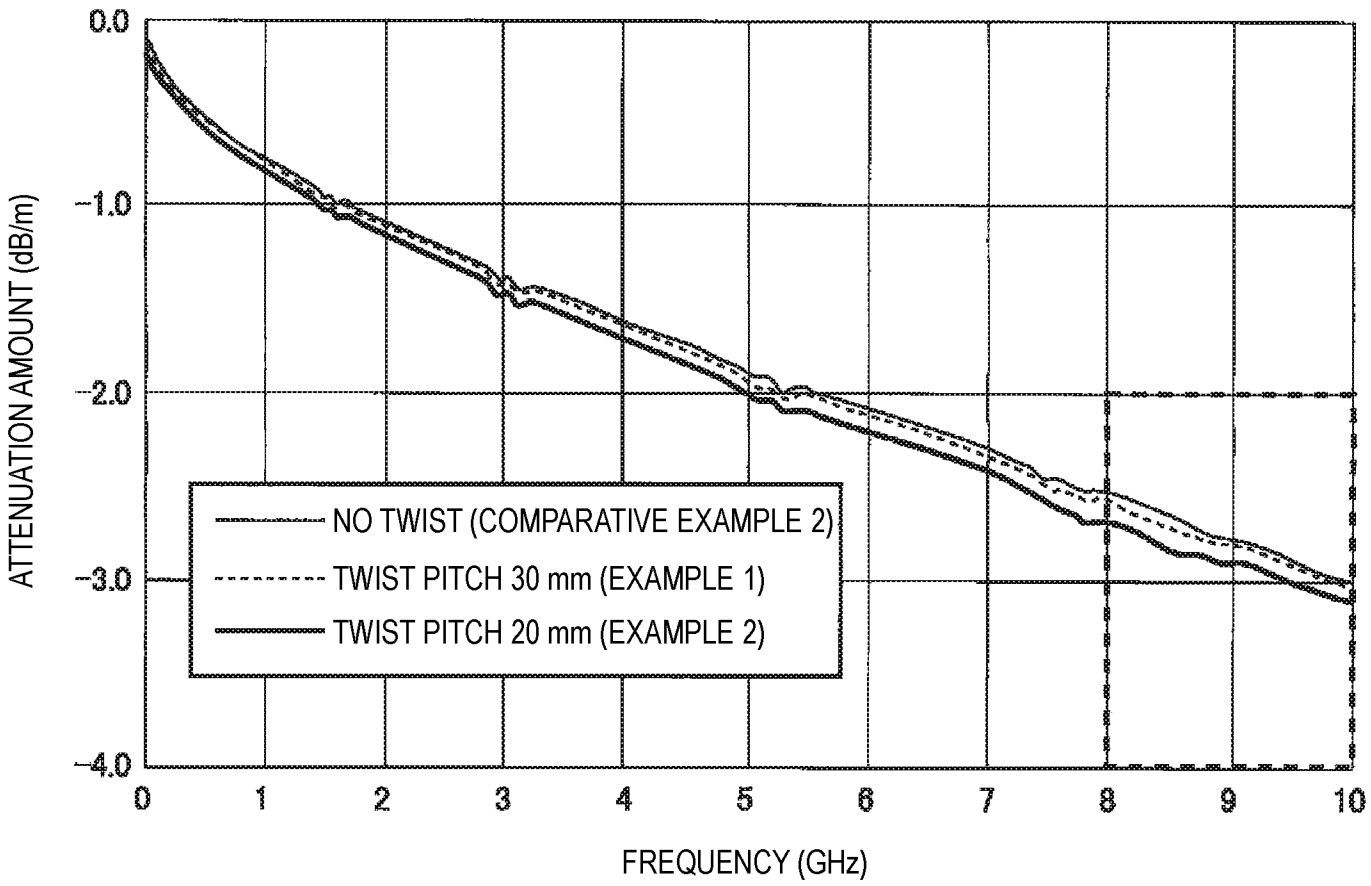
FIG. 4 is a graph showing communication characteristics of the bending-resistant communication cables according to Examples 1 and 2 and Comparative Example 2.
Figure 5:
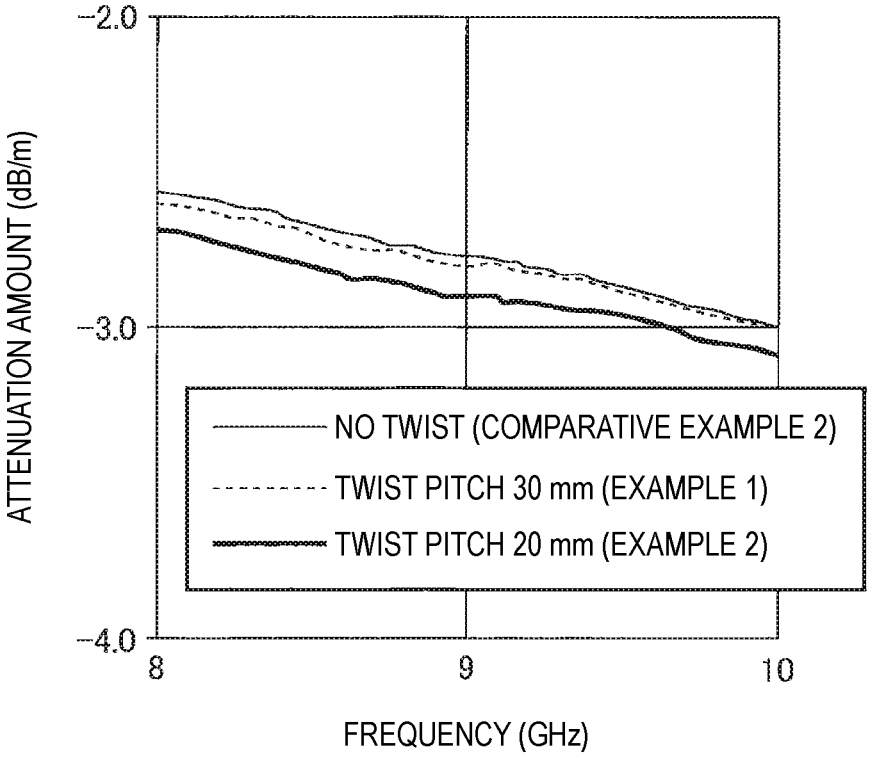
FIG. 5 is a graph showing the communication characteristics of the bending-resistant communication cables according to Examples 1 and 2 and Comparative Example 2, and is a partially enlarged view of FIG. 4.

FIGS. 4 and 5 are graphs showing communication characteristics of the bending-resistant communication cables according to Examples 1 and 2 and Comparative Example 2.

The bending-resistant communication cable according to Example 1 was the same as that of Reference Example except that the twist pitch of the parallel two-core shielded wires was 30 mm. A bending-resistant communication cable according to Example 2 was the same as that of Reference Example except that a twist pitch of parallel two-core shielded wires was 20 mm. The bending-resistant communication cable according to Comparative Example 2 was the same as that of Reference Example except that the parallel two-core shielded wires were not twisted.

As shown in FIGS. 4 and 5, an attenuation amount is the largest in Example 2 having the twist pitch of 20 mm and is the second largest in Example 1 having the twist pitch of 30 mm. In Comparative Example 2 without a twist, the attenuation amount is the smallest.

Accordingly, in the bending-resistant communication cable, the attenuation amount tends to increase as the twist pitch of the parallel two-core shielded wires becomes smaller. For this reason, it can be said that the larger the twist pitch is, the more preferable the twist pitch is. Even when the twist pitch is 20 mm, a difference in the attenuation amount is about 0.1 dB/m as compared with a case where no twist exists, and the attenuation amount is within an allowable range. Therefore, it is found that the twist pitch may be 20 mm or more.

Figure 6:
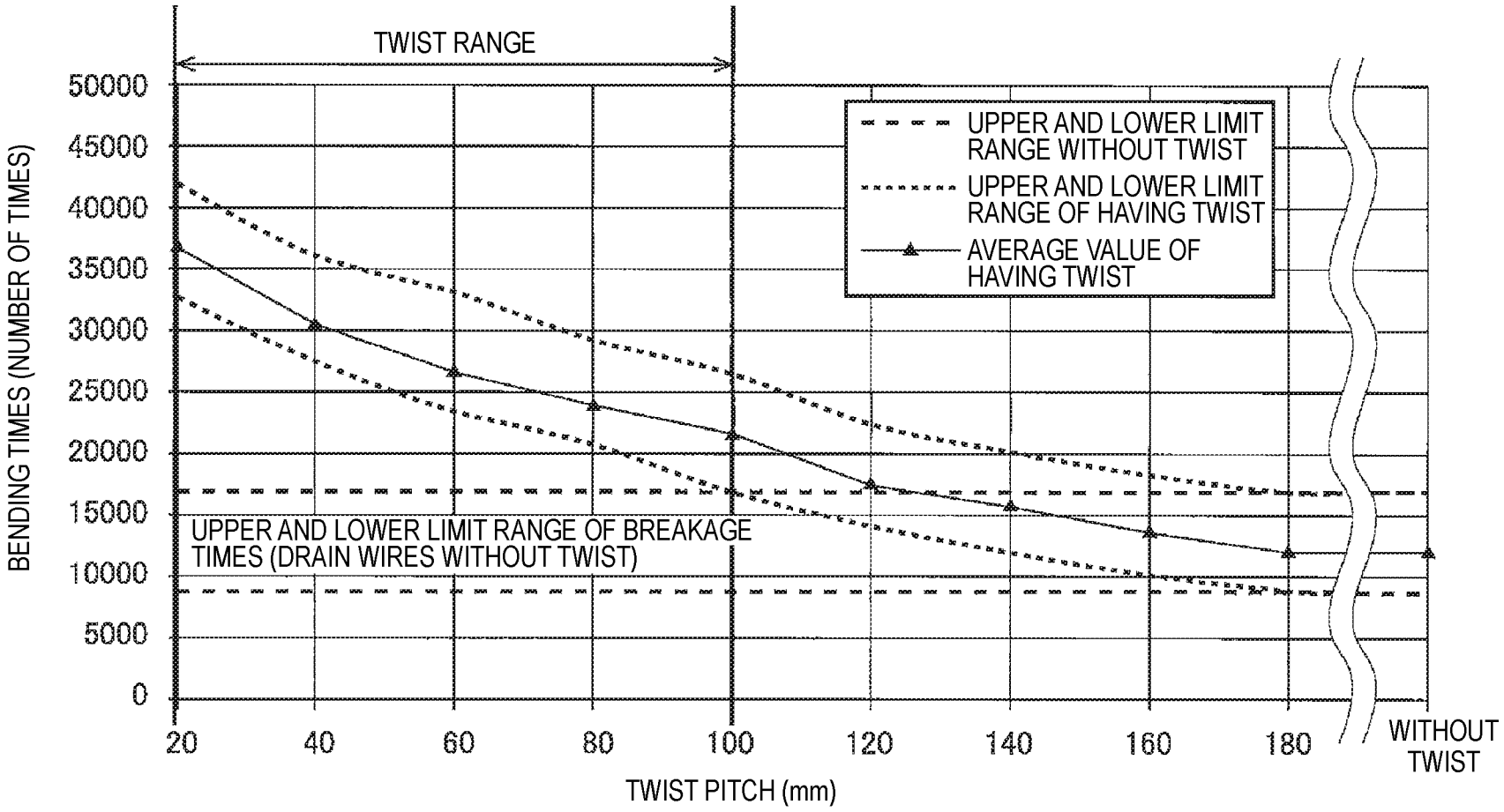
FIG. 6 is a graph showing a correlation between a twist pitch and bending resistance of a bending-resistant communication cable.

FIG. 6 is a graph showing a correlation between a twist pitch and bending resistance of a bending-resistant communication cable.

In a bending-resistant communication cable having characteristics shown in FIG. 6, a silver-plated soft copper wire is used for conductors of two communication wires and a drain wire, and a cross-linked polyethylene is used for insulators. Further, a copper foil PET film is used for an external conductor, and the copper foil PET film is longitudinally wrapped around the two communication wires and the drain wire. A PET film is used for a retainer, and is spirally wound twice on the external conductor. Two parallel two-core shielded wires configured in this way are prepared, and twisted such that the drain wires are on inside. A tin-plated soft copper braid is used for a second shield layer, and PVC is used for a sheath.

Five bending tests were performed for nine bending-resistant communication cables having twist pitches changed from 20 mm and in increments of 20 mm, and for a bending-resistant communication cable without a twist, a maximum value and a minimum value were extracted, and an average value was calculated. A test result shown in FIG. 6 was obtained by performing a bending test under conditions same as those of the test shown in FIG. 3, and by performing measurement on the drain wires on a side far from a mandrel.

As shown in FIG. 6, a minimum value of a bending times for the bending-resistant communication cables that have the twist pitches ranging from 20 mm to 80 mm is larger than a maximum value of a bending times for the bending-resistant communication cable without a twist. On the other hand, a minimum value of a bending times for the bending-resistant communication cables that have the twist pitches ranging from 100 mm to 180 mm is equal to or smaller than a maximum value (approximately coincides with a twist pitch of 100 mm) of a bending times for the bending-resistant communication cable without a twist.

Therefore, it is found that the bending resistance of the bending-resistant communication cable is improved as the twist pitch of the parallel two-core shielded wires becomes smaller, and particularly when the twist pitch is less than 100 mm, the bending resistance can be improved as compared with the case where no twist exists.

From the above, it is found that by setting the twist pitch to be 20 mm or more and less than 100 mm, the bending resistance can be improved while preventing an adverse effect on the attenuation amount.

In this way, according to the bending-resistant communication cable 1 in the present embodiment, since the drain wire 12 of each of the plurality of parallel two-core shielded wires 10 is arranged to face the inside of the cable, a strain applied to the drain wire 12 can be reduced and the bending resistance can be improved by increasing the distance from the outermost layer of the cable to which vehicle vibration from outside or bending is applied. Further, since the twist is performed with a twist pitch being less than 100 mm, the bending resistance of the drain wire 12 can be improved as compared with the case where the parallel two-core shielded wires 10 are not twisted together. Therefore, the bending resistance of the drain wire 12 can be improved. Although a twist pitch of 20 mm may affect communication performance, a difference in the attenuation amount is within 0.1 dB/m as compared with the case where no twist exists, which is within an allowable range.

Further, since the secant modulus of the retainer 14 is 2850 Mpa or more and 4200 Mpa or less, the electric wire structure can be stabilized and cannot be excessively bent during bending, and the bending R can be stabilized.

Further, according to the wire harness WH in the present embodiment, the wire harness WH can be provided which shows the excellent bending performance for bending assumed in a vehicle (particularly, a door). Specifically, a bending of 180° in an alternating stress condition is assumed when the bending R is 25 mm (mandrel ϕ50 mm) in the vehicle. When a vehicle usage frequency is 312 days per year, an opening and closing times of a door per day is 8, and the number of years in use of the vehicle is 10, the assumed bending times is 25000 (24960). The wire harness WH according to the present embodiment can satisfy such a bending times, and the wire harness WH showing the excellent bending performance for the bending assumed in the vehicle (particularly, a door) can be provided.

Although the present invention has been described based on the embodiment, the present invention is not limited to the above embodiment, various modifications may be made without departing from the spirit of the invention, and if possible, known or well-known technologies may be combined.

For example, although an example of two parallel two-core shielded wires 10 is shown in the present embodiment, the present invention is not limited thereto, and the number of parallel two-core shielded wires 10 may be three or more. Further, when a large number of parallel two-core shielded wires 10 are provided, a center material may be provided at a center position of the bending-resistant communication cable 1. In addition, although the retainer 14 is provided in the contact state on the external conductor 13, the present invention is not limited thereto, and several layers of inclusions may be provided between the external conductor 13 and the retainer 14.

What is claimed is:

1. A bending-resistant communication cable comprising:

a parallel two-core shielded wire that includes a drain wire in a gap between two-core communication wires and is formed by collectively covering the two-core communication wires and the drain wire by a metal foil, and a sheath that collectively covering a plurality of the parallel two-core shielded wires, wherein each of the drain wires in the plurality of the parallel two-core shielded wires is arranged to face inside of the bending-resistant communication cable, wherein the plurality of two-core shielded wires are twisted together and a twist pitch of the plurality of two-core shielded wires is 20 mm or more and less than 100 mm, and wherein each of the plurality of two-core shielded wires has a retainer provided on an outer periphery of the metal foil, and portions of the retainers are located between the drain wires, and the portions of the retainers abut each other at a center of the bending-resistant communication cable, in a radial direction.

2. The bending-resistant commination cable according to claim 1, wherein a secant modulus of the retainer is 2850 MPa or more and 4200 MPa or less.

3. A wire harness comprising the bending-resistant communication cable described in claim 1.

* * * * *